US009953565B2

(12) United States Patent
Lee et al.

(10) Patent No.: US 9,953,565 B2
(45) Date of Patent: Apr. 24, 2018

(54) ORGANIC LIGHT EMITTING DIODE DISPLAY AND METHOD FOR DRIVING THE SAME

(71) Applicant: LG Display Co., Ltd., Seoul (KR)

(72) Inventors: Joonhee Lee, Seoul (KR); Sunghoon Kim, Paju-si (KR); Jongmin Park, Anyang-si (KR)

(73) Assignee: LG Display Co., Ltd., Seoul (KR)

( * ) Notice: Subject to any disclaimer, the term of this patent is extended or adjusted under 35 U.S.C. 154(b) by 223 days.

(21) Appl. No.: 14/794,594

(22) Filed: Jul. 8, 2015

(65) Prior Publication Data

US 2016/0189603 A1 Jun. 30, 2016

(30) Foreign Application Priority Data

Dec. 24, 2014 (KR) ..... 10-2014-0188899

(51) Int. Cl.

| | |
|---|---|
| ***G09G 3/32*** | (2016.01) |
| ***G09G 3/3208*** | (2016.01) |
| ***G09G 3/20*** | (2006.01) |
| ***G09G 3/3225*** | (2016.01) |
| ***G09G 3/3266*** | (2016.01) |
| ***G09G 3/3258*** | (2016.01) |

(52) U.S. Cl.

CPC ..... *G09G 3/3208* (2013.01); *G09G 3/2022* (2013.01); *G09G 3/3225* (2013.01); *G09G 3/3258* (2013.01); *G09G 3/3266* (2013.01); *G09G 2300/0413* (2013.01); *G09G 2300/0819* (2013.01); *G09G 2300/0861* (2013.01); *G09G 2310/0202* (2013.01); *G09G 2310/08* (2013.01); *G09G 2320/0204* (2013.01); *G09G 2320/0219* (2013.01); *G09G 2320/0223* (2013.01); *G09G 2320/0233* (2013.01)

(58) Field of Classification Search

CPC ..... G09G 3/3208; G09G 2320/0223

See application file for complete search history.

(56) References Cited

U.S. PATENT DOCUMENTS 5,504,504 A * 4/1996 Markandey ..... G02B 26/0841 345/214
5,973,655 A * 10/1999 Fujisaki ..... G09G 3/2022 345/63
7,164,405 B1 * 1/2007 Jeong ..... G09G 3/3688 345/94

(Continued)

OTHER PUBLICATIONS

European Extended Search Report, European Application No. 15178299.2, dated May 6, 2016, 8 pages.

*Primary Examiner* — Dorothy Harris
(74) *Attorney, Agent, or Firm* — Fenwick & West LLP

(57) ABSTRACT

An organic light emitting diode display and a method for driving the same are disclosed. The organic light emitting diode display includes a display panel including a plurality of pixels, a display panel driver configured to drive signal lines of the display panel, and a timing controller configured to divide one frame into a plurality of subframes, divide data of an input image at each bit, map the data of the input image to the plurality of subframes, control an operation of the display panel driver, and adjust data addressing speeds of the plurality of subframes for adjusting the emission times of the upper and lower display lines of the display panel differently.

19 Claims, 11 Drawing Sheets

(56) References Cited

U.S. PATENT DOCUMENTS

| | | | | |
|---|---|---|---|---|
| 2001/0055384 | A1* | 12/2001 | Yamazaki | G06F 3/0202 379/419 |
| 2002/0000576 | A1* | 1/2002 | Inukai | G09G 3/3266 257/202 |
| 2002/0044140 | A1* | 4/2002 | Inukai | G09G 3/2011 345/204 |
| 2002/0135312 | A1* | 9/2002 | Koyama | G09G 3/3225 315/169.3 |
| 2002/0140364 | A1* | 10/2002 | Inukai | G09G 3/2074 315/169.3 |
| 2004/0041754 | A1 | 3/2004 | Inukai | |
| 2004/0095364 | A1 | 5/2004 | Koyama et al. | |
| 2004/0217932 | A1 | 11/2004 | Nally et al. | |
| 2005/0259121 | A1* | 11/2005 | Miyagawa | G09G 3/3233 345/690 |
| 2006/0071884 | A1* | 4/2006 | Kim | G09G 3/3233 345/76 |
| 2006/0220572 | A1* | 10/2006 | Seki | G09G 3/2025 315/100 |
| 2007/0085798 | A1* | 4/2007 | Hashimoto | G09G 3/3648 345/93 |
| 2009/0278869 | A1 | 11/2009 | Oishi et al. | |
| 2012/0200554 | A1* | 8/2012 | Kim | G09G 3/344 345/211 |
| 2015/0279259 | A1 | 10/2015 | Jang et al. | |

* cited by examiner

ORGANIC LIGHT EMITTING DIODE DISPLAY AND METHOD FOR DRIVING THE SAME

This application claims the benefit of Korean Patent Application No. 10-2014-0188899 filed on Dec. 24, 2014, which is incorporated herein by reference for all purposes as if fully set forth herein.

BACKGROUND OF THE INVENTION

Field of the Invention

Embodiments of the invention relate to an organic light emitting diode display driven through a digital driving method and a method for driving the same.

Discussion of the Related Art

Because an organic light emitting diode display (hereinafter, referred to as "OLED display") is a self-emission display device, the OLED display may be manufactured to have lower power consumption and thinner profile than a liquid crystal display requiring a backlight unit. Further, the OLED display has advantages of a wide viewing angle and a fast response time and thus has expanded its market while competing with the liquid crystal display.

The OLED display is driven through an analog voltage driving method or a digital driving method and may represent grayscale of an input image. The analog voltage driving method adjusts a data voltage applied to pixels based on data gray values of the input image and adjusts a luminance of the pixels based on a magnitude of the data voltage, thereby representing grayscale of the input image. The digital driving method adjusts an emission time of the pixels based on the data gray values of the input image, thereby representing grayscale of the input image.

As shown in FIGS. 1 and 2, the digital driving method time-divides one frame into a plurality of subframes SF1 to SF6. Each subframe represents one bit of input image data. As shown in FIG. 1, each subframe may be divided into an address time ADT, during which data is written on pixels, and an emission time EMT, during which the pixels emit light. As shown in FIG. 2, each subframe may further include an erase time ERT, during which the pixels are turned off, in addition to the address time ADT and the emission time EMT. The emission times of the subframes may have different lengths. However, because a data addressing speed of the subframes is uniformly maintained as a reference value, the emission time of the same subframe is uniform irrespective of a position of the display panel.

As shown in FIG. 3, because IR drop resulting from a line resistance is generated in the display panel, a high potential power voltage EVDD varies depending on a spatial position of the display panel to thereby generate a luminance deviation. The luminance implemented in the display panel decreases as the display panel is far from an input terminal of the high potential power voltage EVDD.

In the analog voltage driving method, a driving thin film transistor (TFT) is driven in a saturation region. As shown in FIG. 4, the saturation region indicates a voltage region, in which a drain-source current Ids does not substantially change depending on a drain-source voltage Vds of the driving TFT, and is positioned on the right side of the Vds-Ids plane. In other words, in the saturation region, the drain-source current Ids does not change although the high potential power voltage EVDD (i.e., the drain-source voltage Vds of the driving TFT) changes.

On the other hand, in the digital driving method, the driving TFT is driven in an active region, so as to reduce power consumption. As shown in FIG. 4, the active region indicates a voltage region, in which the drain-source current Ids changes depending on the drain-source voltage Vds of the driving TFT, and is positioned on the left side of the Vds-Ids plane. In other words, in the active region, the drain-source current Ids sensitively changes depending on changes in the high potential power voltage EVDD (i.e., the drain-source voltage Vds of the driving TFT).

For this reason, the luminance deviation resulting from the IR drop is more of a problem in the digital driving method than the analog voltage driving method.

SUMMARY OF THE INVENTION

Accordingly, embodiments of the invention provide an organic light emitting diode display driven through a digital driving method and a method for driving the same capable of minimizing a luminance deviation resulting from an IR drop.

In one aspect, there is an organic light emitting diode display comprising a display panel including a plurality of pixels, a display panel driver configured to drive signal lines of the display panel, and a timing controller configured to divide one frame into a plurality of subframes, divide data of an input image at each bit, map the data of the input image to the plurality of subframes, control an operation of the display panel driver, and adjust data addressing speeds of the plurality of subframes for adjusting the emission times of the upper and lower display lines of the display panel differently.

The timing controller adjusts the data addressing speed of at least one subframe of the plurality of subframes differently from a previously determined reference value.

When a high potential power voltage for driving the pixels is applied to the display panel from an upper side of the display panel and data addressing is sequentially performed from the upper side to a lower side of the display panel in a sequential line manner, the timing controller reduces the data addressing speed as it goes from a first subframe to a last subframe of the one frame, wherein the most significant bit (MSB) of the data will be mapped to the first subframe, and the least significant bit (LSB) of the data will be mapped to the last subframe.

When a high potential power voltage for driving the pixels is applied to the display panel from a lower side of the display panel and data addressing is sequentially performed from an upper side to the lower side of the display panel in a sequential line manner, the timing controller increases the data addressing speed as it goes from a first subframe to a last subframe of the one frame, wherein the most significant bit (MSB) of the data will be mapped to the first subframe, and the least significant bit (LSB) of the data will be mapped to the last subframe.

The timing controller includes a multiplexer configured to receive a plurality of gate shift clocks having different pulse periods and selectively output one of the plurality of gate shift clocks to the display panel driver at start timing of each subframe.

A dummy subframe is further arranged after the last subframe in the one frame. A length of the dummy subframe at an upper display line of the display panel is different from a length of the dummy subframe at a lower display line of the display panel.

The display panel driver applies a data voltage, which causes the pixels not to emit light, to the display panel during the dummy subframe.

In another aspect, there is a method for driving an organic light emitting diode display including a display panel including a plurality of pixels and a display panel driver driving signal lines of the display panel, the method comprising dividing one frame into a plurality of subframes, dividing data of an input image at each bit, and mapping the data of the input image to the plurality of subframes, and controlling an operation of the display panel driver and adjusting data addressing speeds of the plurality of subframes for adjusting the emission times of the upper and lower display lines of the display panel differently.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 5:
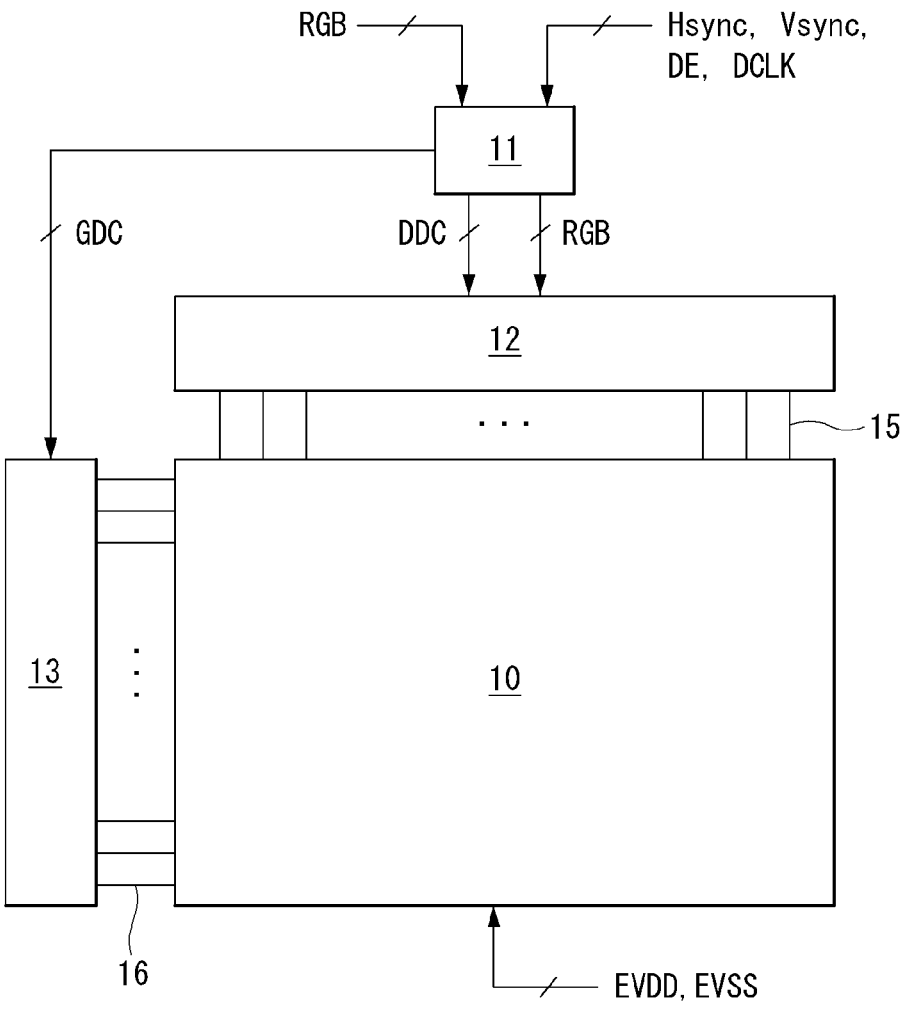
FIGS. 5 and 6 show an organic light emitting diode display according to an exemplary embodiment of the invention.
Figure 6:
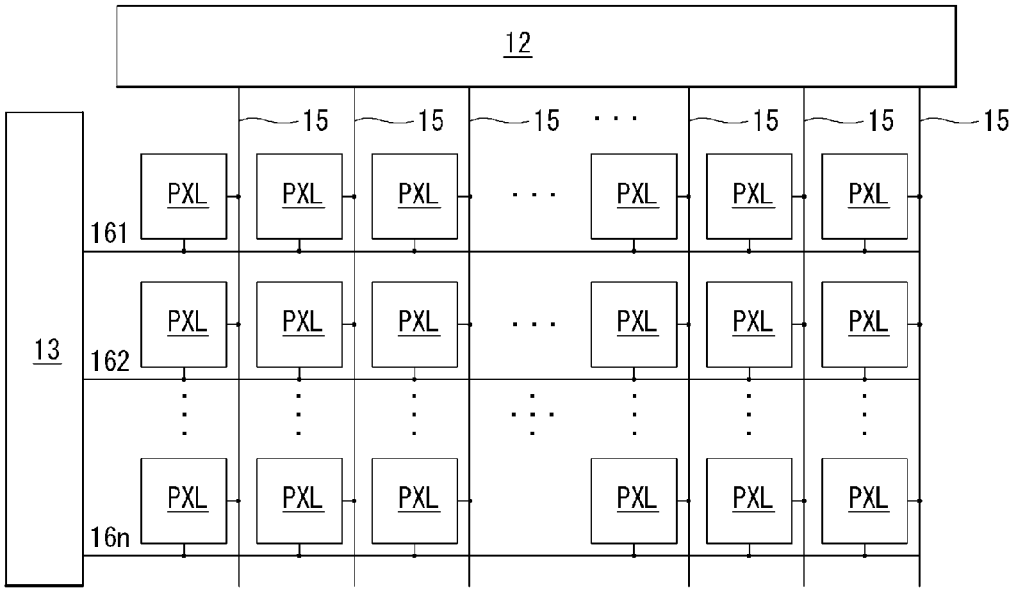
Figure 7:
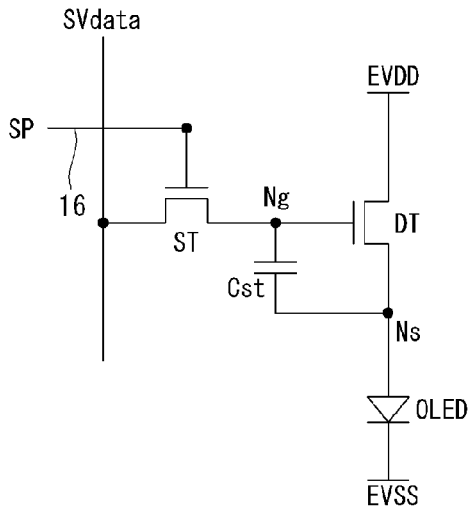
FIG. 7 is a circuit diagram showing one pixel of the organic light emitting diode display shown in FIG. 6.

FIGS. 5 to 7 show an organic light emitting diode display (hereinafter, referred to as "OLED display") according to an exemplary embodiment of the invention.

Referring to FIGS. 5 to 7, the OLED display according to the embodiment of the invention includes a display panel 10, display panel drivers 12 and 13 for writing pixel data of an input image on a pixel array of the display panel 10, and a timing controller 11 for controlling the display panel drivers 12 and 13.

On the pixel array of the display panel 10, a plurality of data lines 15 and a plurality of scan lines (or gate lines) 16 cross each other. The pixel array of the display panel 10 includes pixels PXL that are arranged in a matrix form and display the input image. Each pixel PXL may be one of a red (R) pixel, a green (G) pixel, a blue (B) pixel, and a white (W) pixel. As shown in FIG. 7, each pixel PXL may include a plurality of thin film transistors (TFTs), an organic light emitting diode (OLED), a capacitor, and the like.

The display panel drivers 12 and 13 include a data driver 12 and a gate driver 13.

The data driver 12 generates a data voltage SVdata based on data RGB of the input image received from the timing controller 11 and outputs the data voltage SVdata to the data lines 15. In a digital driving method, an amount of light emitted by the pixels PXL is uniform, and grayscale of the data RGB is represented through an amount of emission time, during which the pixels PXL emit light. Therefore, the data driver 12 selects one of a voltage satisfying an emission condition of the pixels PXL and a voltage not satisfying the emission condition of the pixels PXL depending on digital values of the data RGB mapped to the subframe and generates the data voltage SVdata.

The gate driver 13 sequentially supplies a scan pulse (or a gate pulse) SP synchronized with the data voltage SVdata of the data driver 12 to the scan lines 16 (i.e., 16*l* to 16*n*) under the control of the timing controller 11. The gate driver 13 sequentially shifts the scan pulse SP and sequentially selects the pixels PXL, to which the data voltage SVdata is applied, on a per line basis.

The timing controller 11 receives the pixel data RGB of the input image and timing signals synchronized with the pixel data RGB from a host system (not shown). The timing controller 11 controls operation timing of the data driver 12 and operation timing of the gate driver 13 based on the timing signals synchronized with the pixel data RGB of the input image and synchronizes the data driver 12 and the gate driver 13. The timing signals include a vertical sync signal Vsync, a horizontal sync signal Hsync, a data enable signal DE, a dot clock DCLK, and the like. The timing controller 11 generates a source timing control signal DDC controlling the operation timing of the data driver 12 and a gate timing control signal GDC controlling the operation timing of the gate driver 13.

Figure 8:
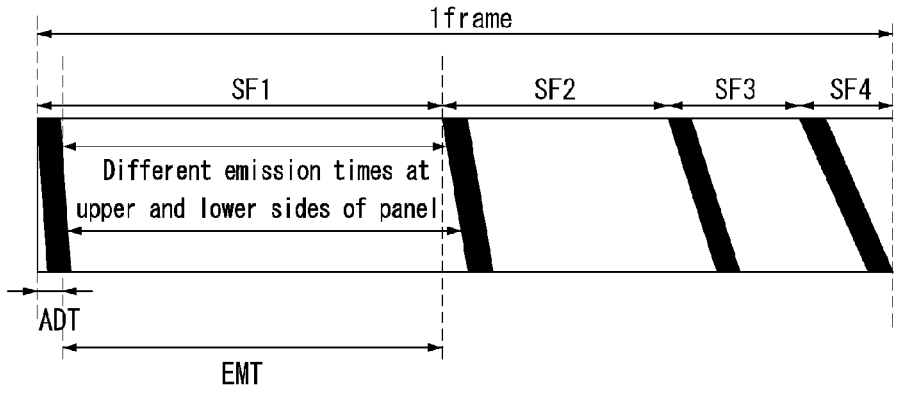
FIG. 8 shows an example of adjusting a data addressing speed so as to minimize a luminance deviation resulting from an IR drop.
Figure 10:
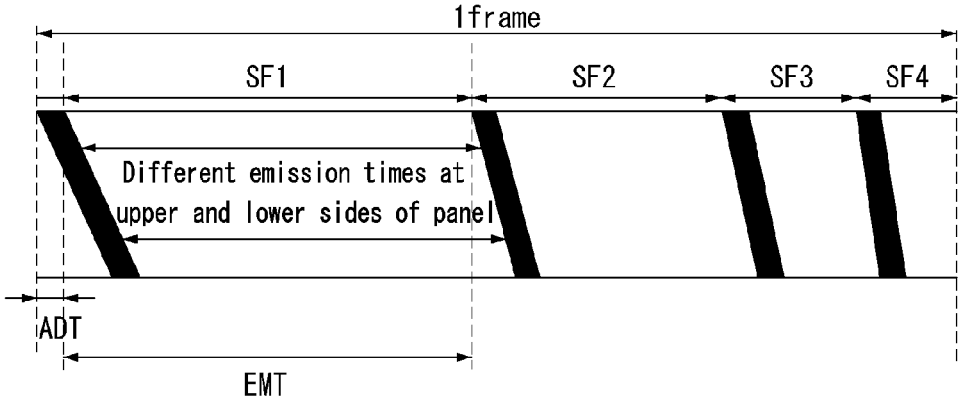
FIG. 10 shows another example of adjusting a data addressing speed so as to minimize a luminance deviation resulting from an IR drop.
Figure 14:
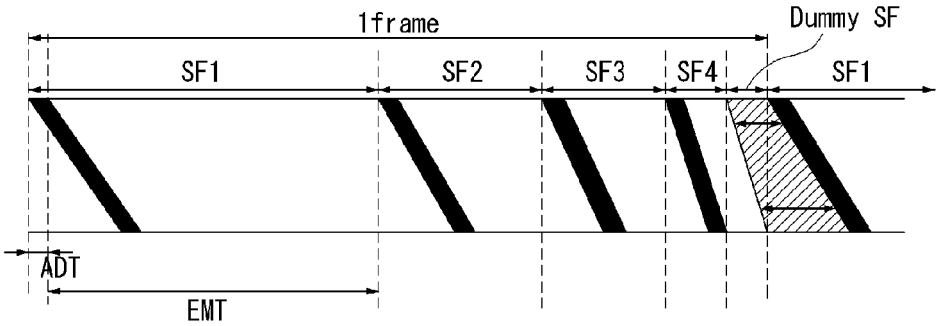
FIG. 14 shows frame configuration of an organic light emitting diode display further including a dummy subframe in one frame.

The timing controller 11 controls the display panel drivers 12 and 13 through the digital driving method. The timing controller 11 divides one frame into a plurality of subframes. Each subframe represents one bit of the data of the input image. As shown in FIGS. 8, 10, and 14, each subframe includes an address time ADT, during which the data is written on the pixels PXL, and an emission time EMT, during which the pixels PXL emit light. As shown in FIGS. 8 and 10, lengths of the emission times EMT of the subframes may be differently set depending on a data bit of the input image. For example, the most significant bit (MSB) represents a high gray level and thus may be mapped to the subframe having the longest emission time, and the least significant bit (LSB) represents a low gray level and thus may be mapped to the subframe having the smallest emission time. The timing controller 11 maps the data RGB of the input image to the subframe at each bit and transmits the data RGB to the data driver 12.

The timing controller 11 controls operations of the display panel drivers 12 and 13 and adjusts data addressing speeds of the subframes. Hence, the timing controller 11 differently adjusts emission times of upper and lower display lines of the display panel 10 and can suppress a luminance deviation resulting from IR drop depending on a position of the display panel 10.

The timing controller 11 may adjust the data addressing speed of at least one subframe of the plurality of subframes differently from a previously determined reference value and may differently adjust the emission times of the upper and lower display lines of the display panel 10. Further, the timing controller 11 may gradually increase or reduce the data addressing speed as it goes from a first subframe to a last subframe of the plurality of subframes, thereby adjusting the emission times of the upper and lower display lines of the display panel 10 differently.

The host system may be implemented as one of a television system, a set-top box, a navigation system, a DVD player, a Blu-ray player, a personal computer (PC), a home theater system, and a phone system.

As shown in FIG. 7, each pixel PXL includes an OLED, a driving TFT DT, a switching TFT ST, a storage capacitor Cst, and the like.

The OLED has a stack structure of organic compound layers including a hole injection layer HIL, a hole transport layer HTL, an emission layer EML, an electron transport layer ETL, an electron injection layer EIL, etc. The OLED generates light when electrons and holes combine in the emission layer EML.

Figure 1:
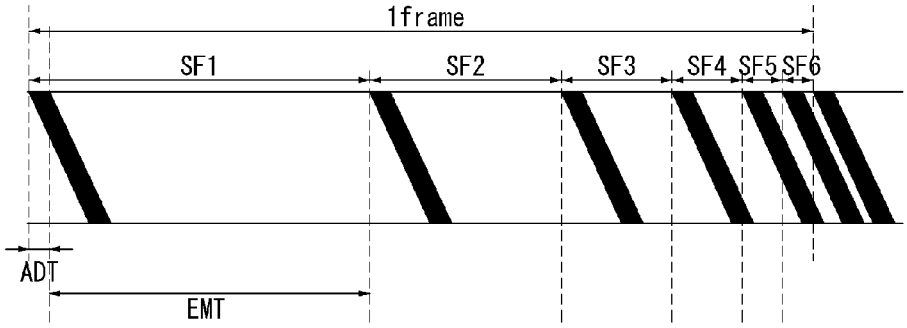
FIG. 1 (RELATED ART)
FIGS. 1 and 2 illustrate a related art digital driving method.
Figure 2:
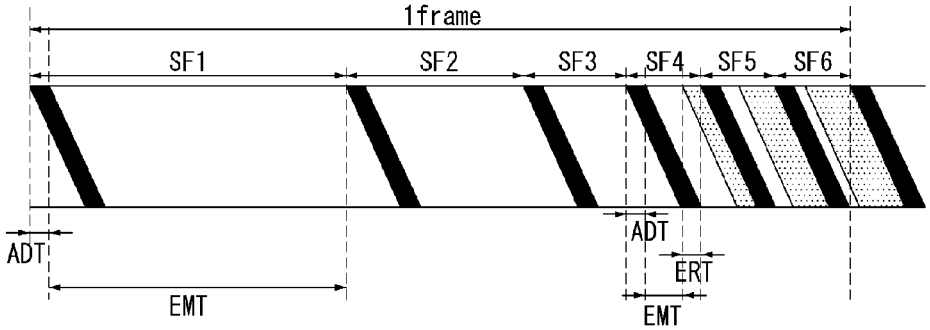
FIG. 2 (RELATED ART)
Figure 3:
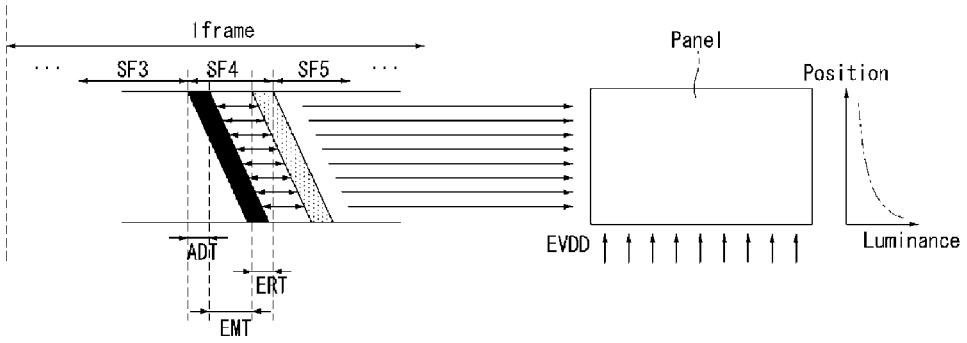
FIG. 3 (RELATED ART)
FIG. 3 shows that a luminance deviation resulting from IR drop is generated depending on a position of a display panel.
Figure 4:
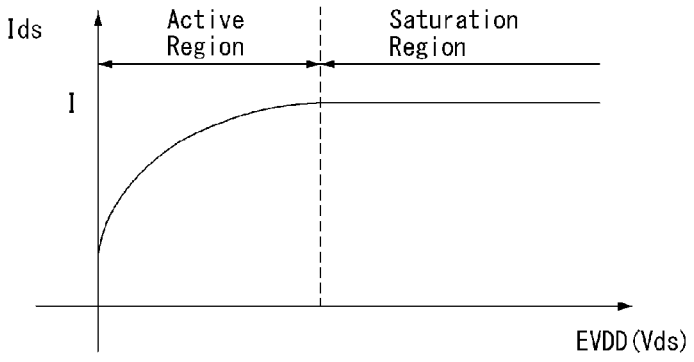
FIG. 4 (RELATED ART)
FIG. 4 shows a graph indicating operating characteristics of a driving thin film transistor (TFT)

The driving TFT DT operates in the active region shown in FIG. 4 and makes the OLED emit light. The driving TFT DT is connected between a power line, to which a high potential power voltage EVDD is supplied, and the OLED switches on or off to a current flowing in the OLED depending on the data voltage SVdata applied to a gate node Ng.

The switching TFT ST is turned on in response to the scan pulse SP from the scan line 16. The switching TFT ST supplies the data voltage SVdata to the gate node Ng in response to the scan pulse SP.

The storage capacitor Cst maintains a gate-source voltage Vgs of the driving TFT DT. The storage capacitor Cst maintains the data voltage SVdata applied to the gate node Ng of the driving TFT DT and keeps the emission of the OLED.

Each pixel PXL of the display panel 10 according to the embodiment of the invention is not limited to the structure shown in FIG. 7 and may have any pixel structure capable of performing the digital driving method.

Figure 9:
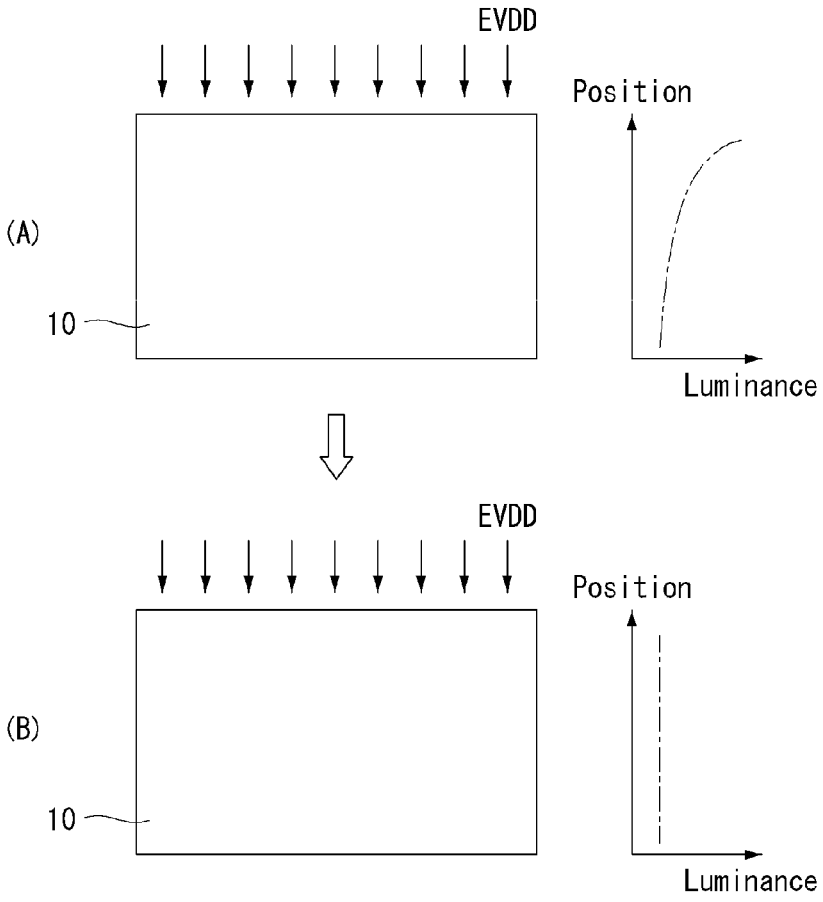
FIG. 9 shows a luminance distribution depending on a position of a display panel before and after the application of FIG. 8.

FIG. 8 shows an example of adjusting the data addressing speed so as to minimize the luminance deviation resulting from the IR drop. FIG. 9 shows a luminance distribution depending on the position of the display panel before and after the application of FIG. 8.

As shown in FIG. 9, in the OLED display according to the embodiment of the invention, the high potential power voltage EVDD for driving the pixels is applied to the display panel 10 from the upper side of the display panel 10, and the data addressing may be sequentially performed from the upper side to the lower side of the display panel 10 in a sequential line manner. In this instance, as shown in (A) of FIG. 9, the luminance deviation resulting from the IR drop depending on the position of the display panel may be generated.

As shown in FIG. 8, as it goes from the first subframe SF1, to which the most significant bit (MSB) of the pixel data RGB will be mapped, to the last subframe SF4, to which the least significant bit (LSB) of the pixel data RGB will be mapped, the timing controller 11 gradually reduces the data addressing speed so as to suppress the luminance deviation. The timing controller 11 causes the emission time EMT at the lower side of the display panel 10 relatively far from an input terminal of the high potential power voltage EVDD to be longer than the emission time EMT at the upper side of the display panel 10 relatively close to the input terminal of the high potential power voltage EVDD by adjusting the data addressing speed as described above.

In the digital driving method, the grayscale of the input image is represented through changes in the length of the emission time EMT. Therefore, an increase in the emission time EMT increases the luminance. Thus, as shown in (B) of FIG. 9, the luminance deviation resulting from the IR drop depending on the position of the display panel 10 is minimized, and the uniform luminance may be implemented irrespective of the upper and lower sides of the display panel.

Figure 11:
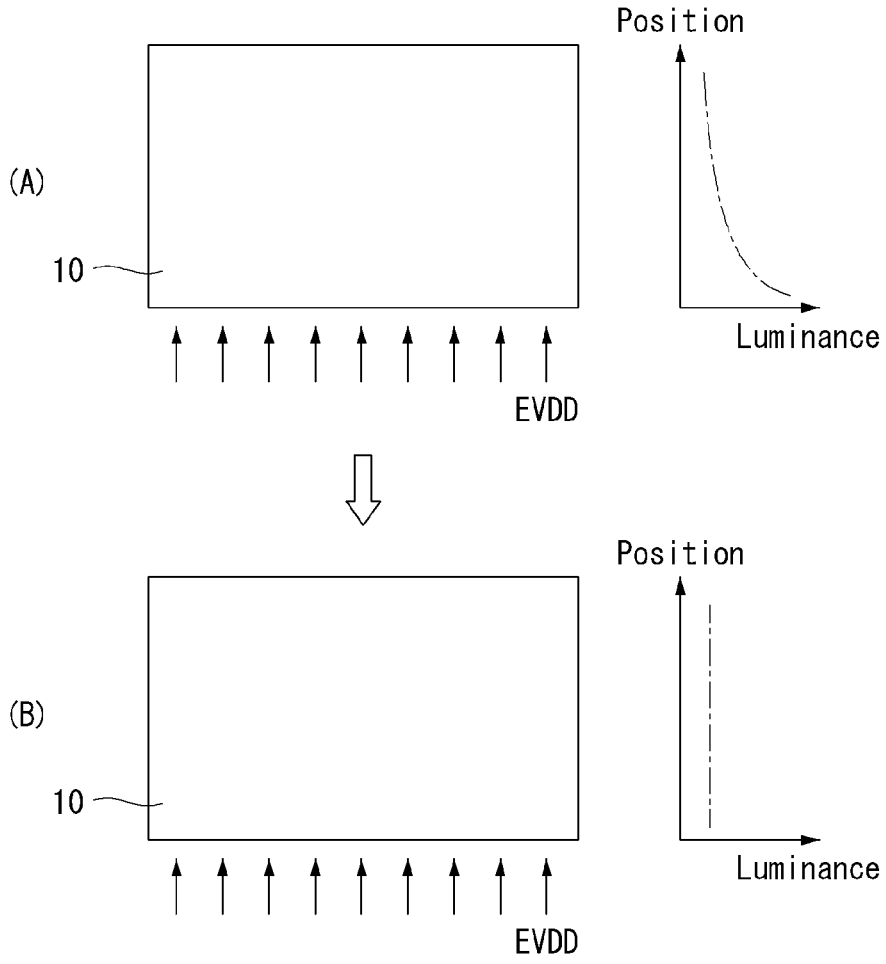
FIG. 11 shows a luminance distribution depending on a position of a display panel before and after the application of FIG. 10.

FIG. 10 shows another example of adjusting the data addressing speed so as to minimize the luminance deviation resulting from the IR drop. FIG. 11 shows a luminance distribution depending on the position of the display panel before and after the application of FIG. 10.

As shown in FIG. 11, in the OLED display according to the embodiment of the invention, the high potential power voltage EVDD for driving the pixels is applied to the display panel 10 from the lower side of the display panel 10, and the data addressing may be sequentially performed from the upper side to the lower side of the display panel 10 in the sequential line manner. In this instance, as shown in (A) of FIG. 11, the luminance deviation resulting from the IR drop depending on the position of the display panel may be generated.

As shown in FIG. 10, as it goes from the first subframe SF1, to which the most significant bit (MSB) of the pixel data RGB will be mapped, to the last subframe SF4, to which the least significant bit (LSB) of the pixel data RGB will be mapped, the timing controller 11 gradually increases the data addressing speed so as to suppress the luminance deviation. The timing controller 11 causes the emission time EMT at the upper side of the display panel 10 relatively far from the input terminal of the high potential power voltage EVDD to be longer than the emission time EMT at the lower side of the display panel 10 relatively close to the input terminal of the high potential power voltage EVDD by adjusting the data addressing speed as described above.

In the digital driving method, the grayscale of the input image is represented through changes in the length of the emission time EMT. Therefore, an increase in the emission time EMT increases the luminance. Thus, as shown in (B) of FIG. 11, the luminance deviation resulting from the IR drop depending on the position of the display panel 10 is minimized, and the uniform luminance may be implemented irrespective of the upper and lower sides of the display panel.

Figure 12:
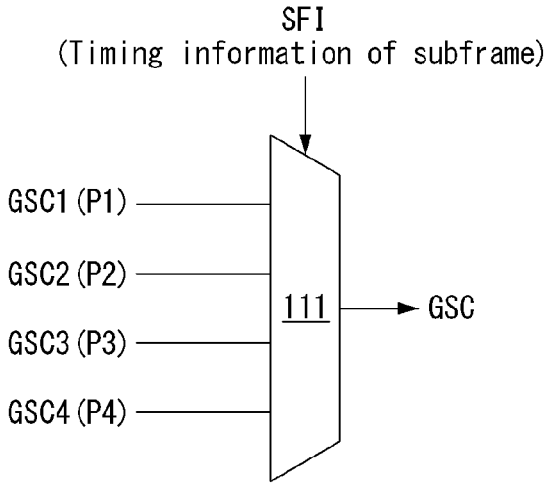
FIG. 12 shows a multiplexer adjusting a pulse period of a gate shift clock in each subframe so as to adjust a data addressing speed.

FIG. 12 shows a multiplexer adjusting a pulse period of a gate shift clock in each subframe so as to adjust the data addressing speed.

The timing controller 11 adjusts a pulse period of a gate shift clock in each subframe so as to adjust the data addressing speed. Because a length of each subframe is previously determined depending on a data bit of the pixel data RGB of the input image, the timing controller 11 may count the timing signals (for example, gate start pulses) capable of defining one frame and produce subframe timing information SFI indicating a start of each subframe of one frame. The timing controller 11 may generate a plurality of gate shift clocks GSC1 to GSC4 having different pulse periods P1 to P4. The gate shift clocks GSC1 to GSC4 are clock signals for shifting the gate start pulse. The gate start pulse controls generation timing of a first gate pulse in one frame.

A multiplexer 111 selectively outputs one of the gate shift clocks GSC1 to GSC4 based on the subframe timing information SFI. In other words, the multiplexer 111 selectively outputs one of the gate shift clocks GSC1 to GSC4 to the display panel driver (i.e., the gate driver 13) at the start timing of each subframe. A width of the scan pulse produced by the gate driver 13 is determined depending on the pulse period of the gate shift clock. The multiplexer 111 may be embedded in the timing controller 11.

The gate driver 13 produces scan pulses shown in FIGS. 13A to 13D based on the gate shift clocks GSC1 to GSC4. FIGS. 13A to 13D show a gate shift clock assigned to each of the first to fourth subframes shown in FIG. 10 and scan pulses based on the gate shift clock.

Figure 13A:
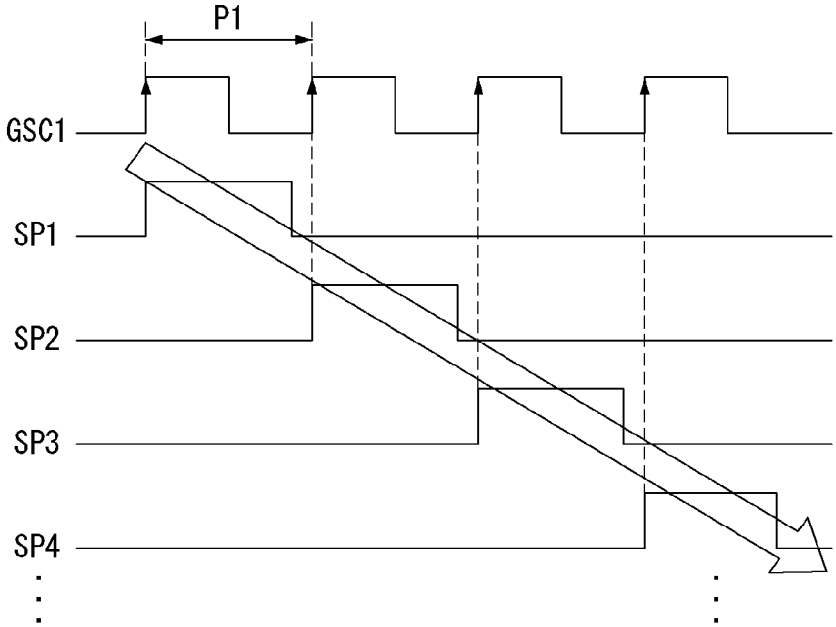
FIGS. 13A to 13D show a gate shift clock assigned to each of first to fourth subframes shown in FIG. 10 and scan pulses based on the gate shift clock.

For example, as shown in FIG. 13A, the gate driver 13 produces first scan pulses SP1-SP4, . . . which have a first pulse width due to the first gate shift clock GSC1 having the first pulse period P1 and are sequentially shifted, in the first subframe SF1 so as to adjust the data addressing speed shown in FIG. 10.

Figure 13B:
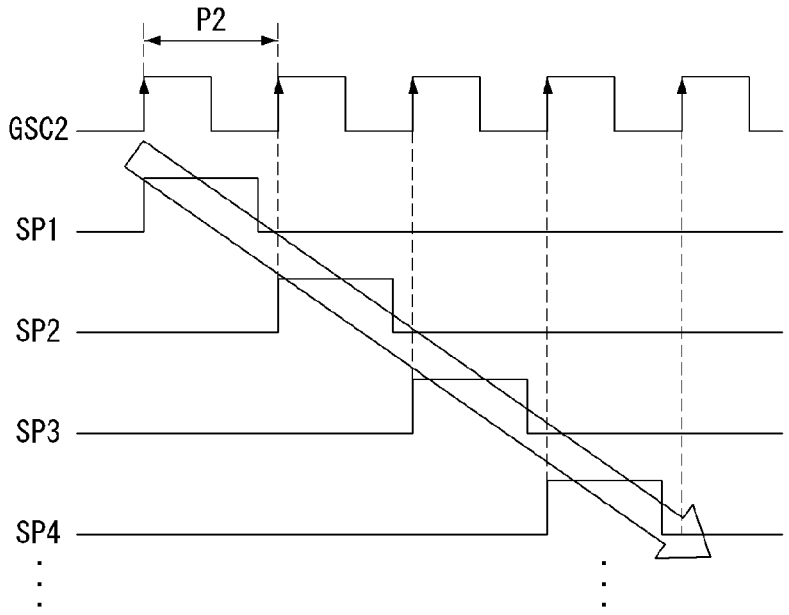

As shown in FIG. 13B, the gate driver 13 produces second scan pulses SP1-SP4, . . . which have a second pulse width less than the first pulse width due to the second gate shift clock GSC2 having the second pulse period P2 shorter than the first pulse period P1 and are sequentially shifted, in the second subframe SF2 following the first subframe SF1. The data addressing speed of the second subframe SF2 is faster than the data addressing speed of the first subframe SF1 due to the second scan pulses SP1-SP4, . . . .

Figure 13C:
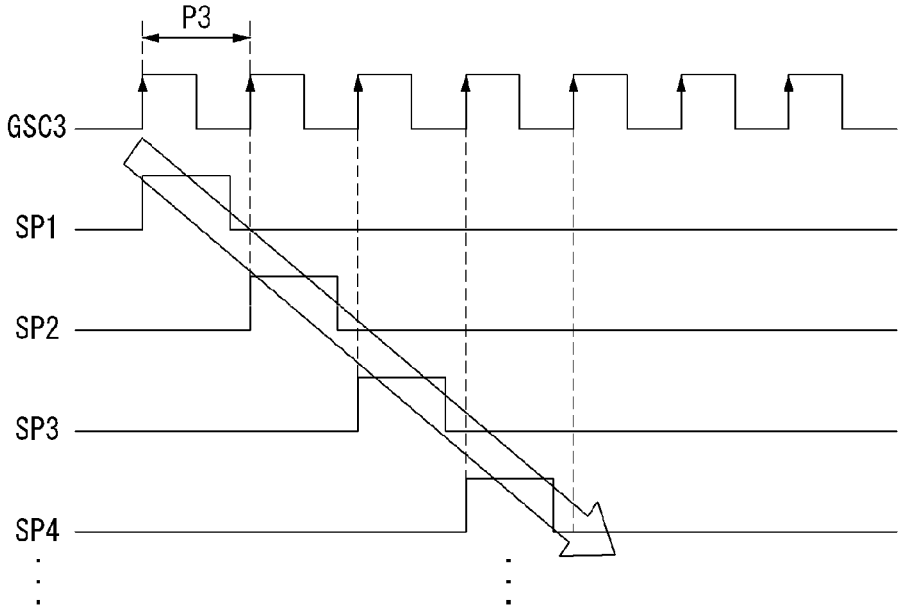

As shown in FIG. 13C, the gate driver 13 produces third scan pulses SP1-SP4, . . . which have a third pulse width less than the second pulse width due to the third gate shift clock GSC3 having the third pulse period P3 shorter than the second pulse period P2 and are sequentially shifted, in the third subframe SF3 following the second subframe SF2. The data addressing speed of the third subframe SF3 is faster than the data addressing speed of the second subframe SF2 due to the third scan pulses SP1-SP4, . . . .

Figure 13D:
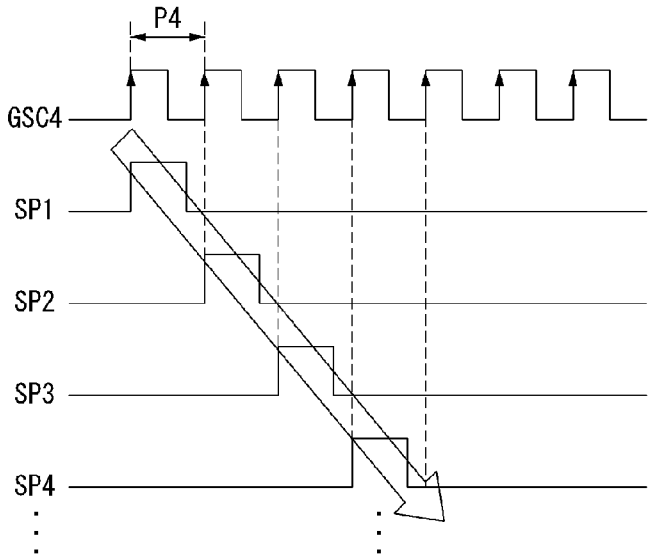

As shown in FIG. 13D, the gate driver 13 produces fourth scan pulses SP1-SP4, . . . which have a fourth pulse width less than the third pulse width due to the fourth gate shift clock GSC4 having the fourth pulse period P4 shorter than the third pulse period P3 and are sequentially shifted, in the fourth subframe SF4 following the third subframe SF3. The data addressing speed of the fourth subframe SF4 is faster than the data addressing speed of the third subframe SF3 due to the fourth scan pulses SP1-SP4, . . . .

FIG. 14 shows frame configuration of the OLED display further including a dummy subframe in one frame.

The data addressing speed may be equally adjusted in each frame for easier luminance control. For example, the data addressing speed of the first subframe is equally adjusted in all the frames, and the data addressing speed of the second subframe is equally adjusted in all of the frames. The data addressing speed of the first subframe may certainly be different from the data addressing speed of the second subframe.

There is still a problem in that emission times of the upper and lower display lines of the display panel in one subframe are different from each other, but the total emission times of all the display lines of the display panel during one frame are the same as one another through the adjustment of the data addressing speed.

Hence, as shown in FIG. 14, the embodiment of the invention further includes a dummy subframe SF after the last subframe SF4 in one frame. A length of the dummy subframe SF at the upper display line of the display panel is different from a length of the dummy subframe SF at the lower display line of the display panel.

The timing controller 11 controls operations of the data driver 12 and the gate driver 13 and adjusts data applied to the display panel 10 and an addressing speed of the data during the dummy subframe SF. The data driver 12 applies the data voltage, which causes the pixels not to emit light, to the display panel 10 under the control of the timing controller 11 during the dummy subframe SF.

The timing controller 11 may cause the data addressing speed of the dummy subframe SF to be the same as or different from the data addressing speed of the last subframe SF4, so that the total emission times of the upper and lower display lines of the display panel during one frame are different from each other.

As an example, when the data addressing speed of at least one of the remaining subframes SF2 to SF4 except the first subframe SF1 is faster than the data addressing speed of the first subframe SF1, the timing controller 11 may cause the data addressing speed of the dummy subframe SF to be the same as or faster than the data addressing speed of the last subframe SF4.

As another example, when the data addressing speed of at least one of the remaining subframes SF2 to SF4 except the first subframe SF1 is slower than the data addressing speed of the first subframe SF1, the timing controller 11 may cause the data addressing speed of the dummy subframe SF to be the same as or slower than the data addressing speed of the last subframe SF4.

As described above, the embodiment of the invention can minimize the luminance deviation resulting from the IR drop by adjusting the emission times of the upper and lower display lines of the display panel differently. The embodiment of the invention further arranges the dummy subframe at the last part of each frame and differently adjusts the length of the dummy subframe at the upper and lower display lines of the display panel, thereby efficiently controlling the emission time.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising:

a display panel including a plurality of pixels, the plurality of pixels including a first set of display lines arranged in rows extending from a gate driver, each display line coupled to a corresponding line of pixels, and the first set of display lines including a first display line and a second display line;

an input terminal receiving a power voltage for driving each of the plurality of pixels via power lines connected to each pixel;

a display panel driver including a data driver and the gate driver, configured to drive signal lines of the display panel; and a timing controller configured to divide one frame into a plurality of subframes including at least a first subframe and a second subframe subsequent to the first subframe and control an operation of the display panel driver to address the plurality of pixels at each of the subframes, wherein a first amount of time for addressing the first set of display lines for the first subframe is greater than a second amount of time for addressing the first set of display lines for the second subframe when the first display line is farther away from the input terminal than the second display line, and the second amount of time is greater than the first amount of time when the second display line is farther away from the input terminal than the first display line.

2. The organic light emitting diode display according to claim 1, wherein each subframe in the plurality of subframes corresponds to a bit of data of an input image.

3. The organic light emitting diode display of claim 2, wherein a most significant bit (MSB) of the data of the input image is mapped to the first subframe and a least significant bit (LSB) of the data of the input image is mapped to a last subframe of the plurality of subframes.

4. The organic light emitting diode display according to claim 1, wherein the input terminal of the power lines is closer to the upper side of the display panel than the lower side of the display panel, wherein data addressing is sequentially performed from the upper side to the lower side of the display panel in a sequential line manner, and wherein the second amount of time is greater than the first amount of time.

5. The organic light emitting diode display according to claim 1, wherein the input terminal of the power lines is closer to the lower side of the display panel than the upper side of the display panel, wherein data addressing is sequentially performed from the upper side to the lower side of the display panel in a sequential line manner, and wherein the first amount of time is greater than the second amount of time.

6. The organic light emitting diode display according to claim 1, wherein the timing controller includes a multiplexer configured to receive a plurality of gate shift clocks having different pulse periods and selectively outputs one of the plurality of gate shift clocks to the display panel driver at start timing of each subframe.

7. The organic light emitting diode display according to claim 1, wherein a dummy subframe is further arranged after a last subframe in the one frame, and wherein a length of the dummy subframe at an upper display line of the display panel is different from a length of the dummy subframe at a lower display line of the display panel.

8. The organic light emitting diode display according to claim 7, wherein the display panel driver applies a data voltage, which causes the pixels not to emit light, to the display panel during the dummy subframe.

9. The organic light emitting diode display of claim 1, wherein an emission time interval of the first display line for the first subframe is longer than an emission time interval of the second display line for the first subframe when the first display line is farther away from the input terminal than the second display line, and wherein the emission time interval of the second display line for the first subframe is longer than the emission time interval of the first display line for the first subframe when the second display line is farther away from the input terminal than the first display line.

10. A method for driving an organic light emitting diode display including a display panel including a plurality of pixels and a display panel driver including a data driver and a gate driver driving signal lines of the display panel, the method comprising:

receiving a power voltage at an input terminal for driving each of the plurality of pixels via power lines connected to each pixel;

dividing one frame into a plurality of subframes including a first subframe and a second subframe subsequent to the first subframe; and controlling an operation of the display panel driver to address the plurality of pixels at each subframe for inputting image data, wherein a first amount of time for addressing a first set of display lines arranged in rows extending from the gate driver for the first subframe is greater than a second amount of time for addressing the first set of display lines for the second subframe when a first display line in the first set of display lines is farther away from the input terminal than a second display line in the first set of display lines, and the second amount of time is greater than the first amount of time when the second display line is farther away from the input terminal than the first display line, wherein each display line is coupled to a corresponding line of pixels.

11. The method according to claim 10, wherein each subframe in the plurality of subframes corresponds to a bit of the input image data.

12. The method according to claim 11, wherein a most significant bit (MSB) of the input image data is mapped to the first subframe and a least significant bit (LSB) of the data of the input image is mapped to a last subframe of the plurality of subframes.

13. The method according to claim 10, wherein the input terminal of the power lines is closer to the upper side of the display panel than the lower side of the display panel, wherein data addressing is sequentially performed from the upper side to the lower side of the display panel in a sequential line manner, and wherein the second amount of time is greater than the first amount of time.

14. The method according to claim 10, wherein the input terminal of the power lines is closer to the lower side of the display panel than the upper side of the display panel, wherein data addressing is sequentially performed from the upper side to the lower side of the display panel in a sequential line manner, and wherein the first amount of time is greater than the second amount of time.

15. The method according to claim 10, wherein the controlling of the operation of the display panel driver includes receiving a plurality of gate shift clocks having different pulse periods and selectively outputting one of the plurality of gate shift clocks to the display panel driver at start timing of each subframe.

16. The method according to claim 10, wherein a dummy subframe is further arranged after a last subframe in the one frame, and wherein a length of the dummy subframe at an upper display line of the display panel is different from a length of the dummy subframe at a lower display line of the display panel.

17. The method according to claim 16, further comprising applying a data voltage, which causes the pixels not to emit light, to the display panel during the dummy subframe.

18. The method of claim 10, wherein an emission time interval of the first display line for the first subframe is longer than an emission time interval of the second display line for the first subframe when the first display line is farther away from the input terminal than the second display line, and wherein the emission time interval of the second display line for the first subframe is longer than the emission time interval of the first display line for the first subframe when the second display line is farther away from the input terminal than the first display line.

19. A display device comprising:

a display panel including a plurality of pixels configured to emit light, the plurality of pixels including a first display line of pixels and a second display line of pixels, arranged in rows extending from a gate driver, each display line coupled to a corresponding line of pixels;

an input terminal receiving a power voltage for driving each of the plurality of pixels via power lines connected to each pixel, wherein the input terminal is closer to the first display line of pixels than to the second display line of pixels;

a display panel driver including a data driver and the gate driver configured to drive signal lines of the display panel; and a timing controller configured to control an operation of the display panel driver to address the plurality of pixels at each subframe among a plurality of subframes for inputting image data, wherein an emission time interval of the first display line of pixels for at least one subframe is shorter than an emission time interval of the second display line of pixels for the at least one subframe.

* * * * *